United States Patent [19]

Jans

[11] 4,118,234

[45] Oct. 3, 1978

[54] ELECTROLESS COPPER PLATING BATH

[75] Inventor: Johannes M. Jans, Eindhoven, Netherlands

[73] Assignee: U.S. Philips Corporation, New York, N.Y.

[21] Appl. No.: 714,111

[22] Filed: Aug. 13, 1976

[30] Foreign Application Priority Data

Aug. 19, 1975 [NL] Netherlands ..... 7509824

[51] Int. Cl.[2] ..... C23C 3/02

[52] U.S. Cl. ..... 106/1.23; 427/430 A; 427/305; 106/1.26

[58] Field of Search ..... 427/98, 92, 304, 437, 427/430 A; 106/1, 1.23, 1.26

[56] References Cited

U.S. PATENT DOCUMENTS

| | | | |
|---|---|---|---|
| 3,649,350 | 3/1972 | Agens | 427/98 |
| 3,708,329 | 1/1973 | Schoenberg | 427/98 X |
| 3,790,392 | 2/1974 | Gilano | 106/1 X |

*Primary Examiner*—Ralph S. Kendall

*Attorney, Agent, or Firm*—Frank R. Trifari; Norman N. Spain

[57] ABSTRACT

An electroless aqueous copper plating bath to which an aromatic nitro compound has been added as a stabilizer.

2 Claims, No Drawings

ELECTROLESS COPPER PLATING BATH

The invention relates to electroless aqueous copper plating baths and in particular to a substance for stabilising these baths.

Electroless copper plating baths contain as a rule formaldehyde, or a compound which yields formaldehyde, as a reducing agent, furthermore, cuprous ions and one or more compounds which form a complex with cuprous ions. The reduction of cuprous ions to a metal can only take place in an alkaline medium, preferably in a pH range between 12 and 13.

Such an alkaline bath is disclosed in U.S. Pat. No. 3,095,309 from which good, ductile copper can be deposited on layers consisting of metal nuclei which may be obtained by chemical or photographical means and which operates as a catalyst for the copper deposition. This copper plating bath contains an inorganic cyanide and/or an organic nitrile as a complexing agent.

United Kingdom Patent Specification No. 1,330,332 discloses a copper plating bath which contains as essential constituents a soluble copper salts, one or more complexing agents, formaldehyde and a polyoxyalkylene compound.

The stability of electroless copper plating solutions has always been a weak point. To improve it various measures have been tried such as filtering, adding a large quantity of methanol, passing oxygen, through it and forming complexes of the cuprous ions. The latter object is brought about in said U.S. Pat. No. 3,095,309 by the addition of cyanide.

U.S. Pat. No. 3,790,392 which proposes the addition of compounds of the thionophosphate type to the copper plating solutions. A nitro group may inter alia be present as a substituent, such as, for example, in the compound diethyl-p-nitrophenylthionophosphate, which is known by the trace work Parathion. This type of compounds is generally very poisonous, which is a great drawback for industrial use. However, toxicity is also a drawback of the above-mentioned cyanide-containing bath.

It has now been found, that simple aromatic nitro compounds are particularly effective for stabilising electroless copper plating solutions containing formaldehyde as a reducing agent. Furthermore a considerable improvement of the selectivity of the patterns is obtained when intensified with the use of this bath as compared to a bath without these nitrocompounds.

According to the invention an aqueous alkaline copper plating bath which contains cuprous ions, a compound which forms complexes with cuprous ions, alkali for adjusting the pH and formaldehyde or a compound which yield formaldehyde, is characterized in that it also contains an additional substance consisting of a substituted aromatic nitrocompound having at least one substituent selected from aldehyde, alkyl, nitro, sulphonic acid, hydroxyalkyl, x-hydroxyketoalkyl ($CO-CH_2OH$) and amino.

It is advantageous if the copper plating bath of the invention also contains at least one polyalkylene oxide compound as shown in United Kingdom Patent Specification No. 1,330,332 or U.S. Pat. No. 3,843,373, col. 1, lines 48–52 of which show polyalkylene oxidic compounds of at least 4 alkaline oxidic groups to be useful in improving the ductility of the depositing copper.

The invention will now be further explained with reference to the following examples. Various aromatic nitro compounds were added to the baths of the following two compositions.

I.
7.5 g/l $CuSO_4.5H_2O$
85 g/l sodium potassium tartrate (Rochelle salt)
15 g/l $Na_2CO_3$
12 g/l NaOH
36 ml/l formaline (solution 37% by weight)
working temperature 25° C.

II.
7.5 g/l $CuSO_4.5H_2O$
21 g/l tetra sodium salt of ethylene diamine tetra acetic-acid
3 g/l NaOH
7 ml/l formaline (solution 37% by weight)
2 g/l "Triton QS 44"
working temperature70° C.

"Triton OS 44" of Rohm and Haas is an alkylphenoxy polyethylene phosphate ester having a molecular weight of approximately 800 and approximately 8 ethoxy groups.

To bath I 0.1 g/l and to bath II 1 g/l was added of one of the following nitro-benzene-derivatives and thereafter 10 ml/l of a solution of 2 g/l $PdCl_2$. The survey below specifies the time in minutes after which the bath became unstable.

| Compound added | Bath I | Bath II |
|---|---|---|
| none | 0 – 2 | 0 – 2 |
| 2 Cl-4 nitro aniline | 10 – 15 | 5 – 10 |
| m-nitrobenzaldehyde | 15 – 20 | 15 – 20 |
| p-nitro toluene | 20 – 25 | 5 – 10 |
| m-nitro benzene-sulphonic acid | 20 – 25 | 5 – 10 |
| o-nitrobenzaldehyde | 25 – 30 | 25 – 30 |
| 1.3-dinitrobenzol | 30 – 35 | 25 – 30 |
| p-nitrobenzaldehyde | 60 – 65 | 40 – 45. |

No improvement in stability was found when inter alia halogenized nitrobenzol, methoxylated nitrobenzol and unsubstituted nitrobenzol were added. The deposition rates of the copper, that is to say 2 μm/hour for bath I and 4 μm/hour for the second bath at the specified working temperature was not influenced by the addition.

What is claimed is:

1. An aqueous alkaline copper plating bath for the electroless deposition of copper layers, said bath containing cuprous ions, a compound which forms complexes with cuprous ions, alkali for adjusting the ph of said bath to about 12 to 13, formaldehyde or a compound which yields formaldehyde and in addition, as a stabilizer, a nitro benzene compound ring substituted with at least one moiety selected from the group consisting of aldehyde, methyl, sulfonic acid and nitro, said stabilizer being present in an amount sufficient to stabilize said bath.

2. The copper plating bath of claim 1 wherein at least one polyalkylene oxidic compound containing at least 4 alkylene oxide groups is present in a concentration effective for improving the ductility of depositing copper.

* * * * *